US006486118B1

(12) United States Patent
Boskamp et al.

(10) Patent No.: US 6,486,118 B1
(45) **Date of Patent: *Nov. 26, 2002**

(54) DETERGENT COMPOSITIONS

(75) Inventors: Jelles Vincent Boskamp; Paulus Jacobus Loomans, both of Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 110 days.

This patent is subject to a terminal disclaimer.

(21) Appl. No.: 09/590,114

(22) Filed: Jun. 8, 2000

(30) Foreign Application Priority Data

Jun. 10, 1999 (GB) ..... 9913549

(51) Int. Cl.[7] ..... C11D 3/382; C11D 11/00; C11D 17/00

(52) U.S. Cl. ..... 510/446; 510/294; 510/298; 510/344; 510/462; 510/464

(58) Field of Search ..... 510/294, 298, 510/446, 344, 462, 464

(56) References Cited

U.S. PATENT DOCUMENTS

| | | | | | |
|---|---|---|---|---|---|
| 522,708 | A | * | 7/1894 | Froidevaux | 510/344 |
| 1,307,149 | A | * | 6/1919 | Robinson | 510/462 |
| 1,659,980 | A | * | 2/1928 | Lindy | 510/462 |
| 1,714,054 | A | * | 5/1929 | Strawther | 510/462 |
| 1,782,805 | A | * | 11/1930 | Broeman | 510/462 |
| 2,560,097 | A | | 7/1951 | Emerson et al. | 252/89 |
| 4,013,581 | A | | 3/1977 | Huber | 252/186 |
| 4,056,400 | A | * | 11/1977 | Diamantoglou et al. | 106/162 |
| 5,104,584 | A | * | 4/1992 | Kong | 510/309 |

FOREIGN PATENT DOCUMENTS

| | | |
|---|---|---|
| EP | 0 379 599 | 8/1990 |
| EP | 0 711 827 | 5/1996 |
| EP | 0 838 519 | 4/1998 |
| GB | 911204 | 11/1962 |
| WO | 90/02165 | 3/1990 |
| WO | 98/40462 | 9/1998 |
| WO | 98/40463 | 9/1998 |
| WO | 98/55575 | 12/1998 |
| WO | 98/55582 | 12/1998 |
| WO | 98/55583 | 12/1998 |
| WO | 98/55590 | 12/1998 |

OTHER PUBLICATIONS

Derwent Abstract of NL 1005417C published Sep. 7, 1998.

* cited by examiner

*Primary Examiner*—Lorna M Douyon
(74) *Attorney, Agent, or Firm*—Rimma Mitelman

(57) ABSTRACT

Detergent tablet of compacted particulate composition containing;

(a) particles which contain organic surfactant together with detergency builder, and (b) water-insoluble but water-swellable particles of plant material which contain both cellulose and lignin, obtainable by fragmentation of plant material without separation of its fibres into a liquid dispersion. Also provided is process of making this tablet which comprises mixing water-insoluble, water-swellable disintegration-promoting material as defined above with other particulate ingredients so as to form a particulate detergent composition and compacting a quantity of the particulate composition in a mold so that it forms a tablet or a region of a tablet. The detergent tablets exhibit good disintegration together with adequate mechanical strength.

17 Claims, No Drawings

DETERGENT COMPOSITIONS

This invention relates to detergent compositions in the form of tablets. These tablets may be used in fabric washing. These tablets are intended to disintegrate when placed in water and thus are intended to be consumed in a single use.

Detergent compositions in tablet form have been described in a number of documents including, for example, GB 911204 (Unilever), WO 90/02165 (Henkel) and EP-A-711827 (Unilever) and are now sold commercially. Tablets have several advantages over powdered products: they do not require measuring and are thus easier to handle and dispense into the washload, and they are more compact, hence facilitating more economical storage.

Detergent tablets are generally made by compressing or compacting a detergent powder, which includes organic surfactant as detergent active and also contains detergency builder.

In such tablets the surfactant functions as a binder, plasticising the tablet. However, it can also retard disintegration of the tablet by forming a viscous gel when the tablet comes into contact with water. Although it is desirable that tablets have adequate strength when dry, yet disperse and dissolve quickly when brought into contact with wash water, it can be difficult to obtain both properties together. Tablets formed using only a light compaction pressure tend to crumble and disintegrate on handling and packing; while more strongly compacted tablets may be sufficiently cohesive but then fail to disintegrate or disperse to an adequate extent in the wash. Tableting will often be carried out with enough pressure to achieve a compromise between these desirable but antagonistic properties. However, it remains desirable to improve one or other of these properties without detriment to the other so as to improve the overall compromise.

The problem has proved especially acute with tablets formed by compressing powders containing surfactant and built with insoluble detergency builder such as sodium aluminosilicate (zeolite).

A number of documents have taught that the disintegration of tablets of cleaning composition can be accelerated by incorporating in the tablet a quantity of a water-insoluble but water-swellable polymeric material. Such documents include WO 98/40462, 98/40463, 98/55575, 98/55582 and 98/55583.

These documents disclose use of cellulosic material derived from timber and subjected to a substantial amount of pretreatment before incorporation into tablets. In some instances the cellulosic fibres are separated from the raw material, dispersed in water and then recovered using a process analogous to papermaking. Wo 98/40462 mentions the use of a material known in the papermaking industry as "Thermomechanical pulp". Fibres obtained from timber by mechanical processing combined with dispersion in water generally contain 35% or more of cellulose and 30% or less of lignin.

Cellulose fibres may be chemically treated to remove this lignin as is done when making high quality white paper. In the papermaking industry the resulting purified fibres are referred to a "chemical fibres".

The use of cruder cellulosic particles such as sawdust or wood flour was suggested many years ago in U.S. Pat. No. 2,560,097, but this was in the context of one-use tablets for hand cleansing, where the material serves as a filler and the tablets were disintegrated in use by handling.

Some tablets which are sold commercially are compacted from a composition which includes particles which contain both surfactant and detergency builder, and other particles which consist of material which is readily water-soluble. This material functions to enhance disintegration of tablets when placed in wash water. For example, EP-A-838519 teaches the use of sodium acetate trihydrate for this purpose. Tablets containing this material can be formulated and compacted so as to disintegrate within an acceptably short time when placed in the drum of a washing machine together with laundry.

It would be desirable to achieve a further increase in the speed of disintegration of tablets, compared to those currently sold commercially, so as to achieve even more reliable disintegration in use and/or to permit the tablets to be placed in the dispenser drawer of a washing machine if the user so desires.

Surprisingly we have found that the disintegration in water of tablets containing particles in which organic surfactant is mixed with other material can be increased using material of vegetable origin which has been processed to suitable size without dispersing the fibres in liquid and recovering them. The improvement in disintegration can be achieved together with adequate mechanical strength.

So, according to a first aspect of this invention there is provided a tablet of compacted particulate composition containing;

(a) particles which contain organic surfactant together with detergency builder, and (b) water-insoluble but water-swellable particles of plant material which contain both cellulose and lignin, obtainable by fragmentation of plant material without separation of its fibres into a liquid dispersion.

The composition is likely to contain particles of other ingredients as well. These, or some of them, may take the form of particles which contain water-soluble salt as at least 50% of their own weight.

The particles of plant material preferably have a mean size, before contact with water, in a range from 250 to 1,500 micrometers, more preferably 400 up to 1,500 micrometers. The mean particle size may be in a range from 250 or 400 up to 1,100 micrometers. Particularly preferred is a mean particle size in a range from 700 to 1,000 micrometers. The material may be sieved so that all of its particles fall within one of these size ranges. In any event, particles larger than 2,000 micrometers are preferably removed, such as by sieving.

The water-insoluble but water-swellable particles may be obtained by breaking up plant material and collecting particles of the desired size, or by comminuting plant material of larger particle size.

One possible form of cellulosic plant material is woodchips or sawdust, which may be milled to a smaller particle size within the preferred range above.

Another possible form of cellulose-containing plant material which may be used is particles of coconut husk material, sometimes known as coir.

Consequently, in a second aspect this invention provides a tablet of compacted particulate composition containing organic surfactant and detergency builder wherein the tablet or a discrete region of the tablet contains disintegration-promoting particles of coconut husk material, which is of course water-insoluble. We have discovered that is it strongly water-swellable.

Forms of this invention, preferred and optional features, and materials which may be used, will now be discussed in greater detail.

Discrete Regions/Whole Tablets

A tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example layers, inserts or coatings, each of which is a matrix of particles derived by compaction from a particulate composition. In a heterogenous tablet according to the present invention, each discrete region of the tablet will preferably have a mass of at least 3 gm.

In a heterogeneous tablet, at least one of its discrete regions contains the said swellable disintegration-promoting particles, and usually will also contain surfactant and detergency builder. For example, there is provided a tablet which contains a pluarity of discrete regions at least one of which contains a greater concentration of the water-insoluble water-swellable disintegration disintegration promoting particles than another region of the tablet.

Proportions

Tablets of this invention will generally contain, overall, from 5 to 50% by weight of organic surfactant and from 5 to 80% by weight of detergency builder. In the case of a heterogenous tablet, a region which contains water-swellable material in accordance with this invention will generally also contain surfactant in an amount which is from 5 to 50% by weight of that region and detergency builder in an amount which is from 5 to 80% by weight of that region. Preferably at least 90% of all organic surfactant present in a homogenous tablet or a said region of a heterogenous tablet is provided within the said particles (a) which contain organic surfactant together with detergency builder. Such particles (a) preferably provide from 25 to 85% by weight of a tablet or tablet region. Preferably also they contain from 12% up to 50% or 60% of their own weight of organic surfactant, from 20 to 88% of -heir own weight of detergency builder and 0 to 68% of any other material.

However, particles (a) which contain surfactant may contain it in a small amount, such as 2 to 10% by weight. In this event it may be sprayed onto a particulate detergency builder or other carrier.

A homogenous tablet, or any region of a heterogenous tablet which contains water-swellable material in accordance with this invention will generally contain it in an amount from 0.1% up to 8 or 10% by weight of the tablet or of that region, although the amount of it might possibly be higher up to 12, 15 or even 20%.

A homogenous tablet, or any region of a heterogenous tablet which contains water-swellable material in accordance with this invention will generally contain from 10% up to 60 or even 75% of particulate ingredients other than the surfactant-containing particles (a) and the water-swellable particles (b). These other ingredients may includes particles which contain water-soluble salt as at least 50% preferably from 80 to 100% of their own weight. Such particles may provide from 10% to 60 or 75% by weight of the tablet or region of a tablet, for example at least 10% by weight.

There are a number of possibilities concerning heterogenous tablets. Water-swellable material may or may not be included in every region of a heterogenous tablet, even though the regions differ from each other in some other feature of their composition. Thus the water-swellable material may be present at different concentrations in different tablet regions; it may be present in one region and absent from another; or it may be present at equal concentration in every region of the tablet.

Coconut Husk Material

Coconuts, from the tree Cocos nucifera have a fibrous husk (more correctly "mesocarp") which surrounds the hard shell.

It is conventional to separate the fibres from this husk and utilise them as a coarse textile or rope material termed "coir". The residue after removal of the fibres can be used in horticulture as a substitute for peat.

For this invention the husk material which is used may be fibres from ripe or immature coconuts—the latter give paler fibres. Alternatively the material may be a husk residue which is left after the removal of at least some fibres. In either case the material is comminuted as necessary e.g. milled, to a suitable particle size. It is a feature of coconut husk material that it contains a high proportion of lignin as well as some cellulose. Typically it contains lignin in an amount which is at least 40% of its overall weight, although this might be reduced in the course of any bleaching treatment, for instance to at least 30% or 35% by weight lignin. The amount of lignin may exceed the amount of cellulose present.

If desired, this coconut-derlved material may be subjected to a bleaching treatment to lighten its colour. The material may also be mixed with a small quantity of surfactant so that the particles do not float on the surface of the wash liquor after the disintegration of a tablet containing them.

The material could come from other plant sources. A number of plants are recognised as sources of natural fibre useful for making textiles (which may be coarse textiles such as sacking), rope or twine. These include such plants as agave which is a source of sisal, jute, flax and hemp plants which are sources of fibres with the same names, and the ceiba tree whose seed capsules yield kapok. If the water-swellable disintegrant material comes from one of these plants, it may be provided by the plant fibres (as might be used for textile or rope making) comminuted to a particle size as discussed above, or it may be provided by residues of the fibrous material after the separation of longer fibres. These various materials include cellulose and some lignin and so can be termed "lignocellulosic".

Surfactant Compounds

Compositions which are compacted to form tablets or tablet regions of this invention contain one or more organic detergent surfactants. In a fabric washing composition, these preferably provide from 5 to 50% by weight of the overall tablet composition, more preferably from 8 or 9% by weight of the overall composition up to 40% or 50% by weight. Surfactant may be anionic (soap or non-soap), cationic, zwitterionic, amphoteric, nonionic or a combination of these.

Anionic surfactant may be present in an amount from 0.5 to 50% by weight, preferably from 2% or 4% up to 30% or 40% by weight of the table composiiion.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is commercially significant as an anionic surfactant.

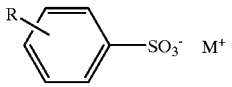

Linear alkyl benzene sulphonate of the formula where R is linear alkyl of 8 to 15 carbon atoms and M+ is a solubilising cation, especially sodium, is also a commercially significant anionic surfactant.

Frequently, such linear alkyl benzene sulphonate or primary alkyl sulphate of the formula above, or a mixture thereof will be the desired anionic surfactant and may provide 75 to 100 wt % of any anionic non-soap surfactant in the composition.

In some forms of this invention the amount of non-soap anionic surfactant lies in a range from 5 to 20 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic surfactant compounds which may be used include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 5 to 20 moles of ethylene oxide per mole of alcohol.

In certain forms of this invention the amount of nonionic surfactant lies in a range from 4 to 40%, better 4 or 5 to 30% by weight of the composition. Many nonionic surfactants are liquids. These may be absorbed onto particles of the composition, prior to compaction into tablets.

Amphoteric surfactants which may be used jointly with anionic or nonionic surfactants or both include amphopropionates of the formula:

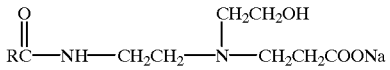

where RCO is an acyl group of 8 to 18 carbon atoms, especially coconut acyl.

The category of amphoteric surfactants also includes amine oxides and also zwitterionic surfactants, notably betaines of the general formula

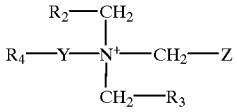

where $R_4$ is an aliphatic hydrocarbon chain which contains 7 to 17 carbon atoms, $R_2$ and $R_3$ are independently hydrogen, alkyl of 1 to 4 carbon atoms or hydroxyalkyl of 1 to 4 carbon atoms such as $CH_2OH$, Y is $CH_2$ or of the form $CONHCH_2CH_2CH_2$ (amidopropyl betaine); Z is either a $COO^-$ (carboxybetaine), or of the form $CHOHCH_2SO_3$—(sulfobetaine or hydroxy sultaine).

Another example of amphoteric surfactant is amine oxide of the formula

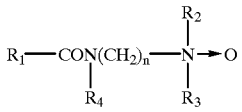

where $R_1$ is $C_{10}$ to $C_{20}$ alkyl or alkenyl $R_2$, $R_3$ and $R_4$ are each hydrogen or $C_1$ to $C_4$ alkyl while n is from 1 to 5.

Cationic surfactants may possibly be used. These frequently have a quaternised nitrogen atom in a polar head group and an attached hydrocarbon group of sufficient length to be hydrophobic. A general formula for one category of cationic surfactants is

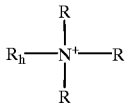

where each R independently denotes an alkyl group or hydroxyalkyl group of 1 to 3 carbon atoms and $R_h$ denotes an aromatic, aliphatic or mixed aromatic and aliphatic group of 6 to 24 carbon atoms, preferably an alkyl or alkenyl group of 8 to 22 carbon atoms.

The amount of amphoteric surfactant, if any, may possibly be from 3% to 20 or 30% by weight of the tablet or region of a tablet; the amount of cationic surfactant, if any, may possibly be from 1% to 10 or 20% by weight of the tablet or region of a tablet.

If the particles of water-swellable material are to be mixed with surfactant, so that they do not end up floating on top of the wash liquor, it is suitable for this purpose to spray them with a liquid anionic surfactant which as Aerosil OT, which is the sodium salt of sulphosuccinic acid by (2-ethylhexyl) ester.

Such a surfactant may be sprayed on in a quantity which is from 0.01 to 10% of the weight of the water-swellable particles, preferably from 0.01 to 1%.

Detergency Builder

A composition which is compacted to form tablets or tablet regions will generally contain from 5, or 10 or better 15 wt % up to 80%, more usually 15 to 60% by weight of detergency builder. This may be provided wholly by water soluble materials, or may be provided in large part or even entirely by water-insoluble material with water-softening properties. Water-insoluble detergency builder may be present as 5 to 80 wt %, better 5 to 60 wt % of the overall composition.

Alkali metal aluminosilicates are strongly favoured as environmentally acceptable water-insoluble builders for fabric washing. Alkali metal (preferably sodium) aluminosllicates may be either crystalline or amorphous or mixtures thereof, having the general formula:

$$0.8\text{–}1.5\ Na_2O.Al_2O_3.\ 0.8\text{–}6SiO_2.\ xH_2O$$

These materials contain some bound water (indicated as $xH_2O$) and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the newer zeolite P described and claimed in EP 384070 (Unilever) and mixtures thereof. This form of zeolite P is also referred to as "zeolite MAP". One commercial form of it is denoted "zeolite A24".

Conceivably a water-insoluble detergency builder could be a layered sodium silicate as described in U.S. Pat. No. 4664839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used.

Water-soluble phosphorus-containing inorganic detergency builders, include the alkali-metal orthophosphates, metaphosphates, pyrophosphates and polyphosphates. Specific examples of inorganic phosphate builders include sodium and potassium tripolyphosphates, orthophosphates and hexametaphosphates. As mentioned above, sodium tripolyphosphate (if any) included in the said particles to promote disintegration will also be part of the detergency builder.

Non-phosphorus water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates. Nitriotriacetate salts, such as sodium nitrilotracetate may also be used as a builder.

Tablet compositions preferably include polycarboxylate polymers, more especially polyacrylates and acrylic/maleic copolymers which can function as builders and also inhibit unwanted deposition onto fabric from the wash liquor.

Particles which contain organic surfactant together with detergency builder and optionally other ingredients can be made by known processes for preparing particulate detergent compositions, often referred to as detergent powders. Such process include spray drying and granulation. Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Bleach System

Tableted detergent compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition. A bleach system may be incorporated as particles which are separate from the surfactant-containing particles and water-swellable particles.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The quaternary ammonium and phosphonium bleach activators disclosed in U.S. Pat. No. 4751015 and U.S. Pat. No. 4818426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

Water-Soluble Disintegration-Promoting Particles

Other ingredients, beside surfactant-containing particles and water-swellable particles, may be particles which contain water-soluble salt as at least 50% of their own weight. Such water-soluble particles may serve to assist disintegration, in addition to the water-swellable, insoluble particles required by this invention.

Such soluble particles typically contain at least 40% (of their own weight) of one or more materials selected from compounds with a water-solubility exceeding 50 grams per 100 grams water, phase I sodium tripolyphosphate, sodium tripolyphosphate which is partially hydrated so as to contain water of hydration in an amount which is at least 0.5% by weight of the sodium tripolyphosphate in the particles.

As will be explained further below, these disintegration-promoting particles can also contain other forms of tripolyphosphate or other salts within the balance of their composition.

If the material in such water-soluble disintegration-promoting particles can function as a detergency builder, (as is the case with sodium tripolyphosphate) them of course it contributes to the total quantity of detergency builder in the tablet composition.

The quantity of water-soluble disintegration-promoting particles is suitably from 3 or 5 or 8% up to 25 or 30% by weight of the tablet or region thereof.

One possibility is that these particles contain at least 40% of their own weight, better at least 50%, of a material which has a solubility in deionised water at 20° C. of at least 50 grams per 100 grams of water.

The said particles may provide material of such solubility in an amount which is at least 7 wt % or 12 wt % of the whole composition of the tablet or discrete region thereof.

A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate | 119 |
| Sodium acetate trihydrate | 76 |
| Magnesium sulphate $7H_2O$ | 71 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated as particles of the material in a substantially pure form (i.e. each such particle contains over 95% by weight of the material). However, the said particles may contain material of such solubility in a mixture with other material, provided that material of the specified solubility provides at least 40% by weight of these particles.

A preferred material is sodium acetate in a partially or fully hydrated form.

It may be preferred that the highly water-soluble material is a salt which dissolves in water in an ionised form. As such a salt dissolves it leads to a transient local increase in ionic strength which can assist disintegration of the tablet by preventing nonionic surfactant from swelling and inhibiting dissolution of other materials.

Another possibility is that water-soluble particles which promote disintegration are particles containing sodium tripolyphosphate with more than 40% (by weight of the particles) of the anhydrous phase I form.

Sodium tripolyphosphate is very well known as a sequestering builder in detergent compositions. It exists in a hydrated form and two crystalline anhydrous forms. These are the normal crystalline anhydrous form, known as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate as at least 50% or 55% by weight of the tripolyphosphate in the particles.

Suitable material is commercially available. Suppliers include Rhone-Poulenc, France and Albright & Wilson, UK.

Another possibility is that the particles which promote disintegration are particles which contain at least 40 wt % sodium tripolyphosphate which is partially hydrated. The extent of hydration should be at least 0.5% by weight of the sodium tripolyphosphate in the particles. It may lie in a range from 0.5 to 4%, or it may be higher. Indeed fully hydrated sodium tripolyphosphate may be used to provide these particles.

It is possible that the particles contain at least 40 wt % sodium tripolyphosphate which has a high phase I content but is also sufficiently hydrated so as to contain at least 0.5% water by weight of the sodium tripolyphosphate.

The remainder of the tablet composition used to form the tablet or region thereof may include additional sodium tripolyphosphate. This may be in any form, including sodium tripolyphosphate with a high content of the anhydrous phase II form.

Other Detergent Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if a detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

It may also be desirable that a detergent tablet of the invention includes an amount of an alkali metal silicate, particularly sodium ortho-, meta- or disilicate. The presence of such alkali metal silicates at levels, for example, of 0.1 to 10 wt %, may be advantageous in providing protection against the corrosion of metal parts in washing machines, besides providing some measure of building and giving processing benefits in manufacture of the particulate material which is compacted into tablets. A composition for fabric washing will generally not contain more than 15 wt % silicate. A tablet for machine dishwashing will frequently contain at least 20 wt % silicate.

Further ingredients which can optionally be employed in fabric washing detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, fabric-softening agents; heavy metal sequestrants such as EDTA; perfumes; and colorants or coloured speckles.

Particle Size and Distribution

A detergent tablet of this invention, or a discrete region of such a tablet, is a matrix of compacted particles.

Preferably the particulate composition has an average particle size in the range from 200 to 2000 μm, more preferably from 250 to 1400 μm. Fine particles, smaller than 180 μm or 200 μm may be eliminated by sieving before tableting, if desired, although we have observed that this is not always essential.

While the starting particulate composition may in principle have any bulk density, the present invention is especially relevant to tablets made by compacting powders of relatively high bulk density,. because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/litre, preferably at least 500 g/litre, and possibly at least 600 g/litre.

A composition which is to be compacted into a tablet or tablet region can be prepared by mixing particles which contain surfactant and detergency builder (preferably all the organic surfactant and at least some builder) with separate particles (b) of water-insoluble, water-swellable disintegration-promoting material, and any other particulate ingredients. Notably, these may include water-soluble particles to promote disintegration. The compaction may suitably occur by compacting a quantity of the particulate composition in a mould so that it forms a tablet or region of a tablet.

Tableting

Tableting entails compaction of a particulate composition. A variety of tableting machinery is known, and can be used. Generally it will function by stamping a quantity of the particulate composition which is confined in a die.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

If any heat is supplied, it is envisaged that this will be supplied conventionally, such as by passing the particulate composition through an oven, rather than by any application of microwave energy.

The size of a tablet will suitably range from 10 to 160 grams, preferably from 15 to 60 g, depending on the conditions of intended use, and whether it represents a dose for an average load in a fabric washing or dishwashing machine or a fractional part of such a dose. The tablets may be of any shape. However, for ease of packaging they are preferably blocks of substantially uniform cross-section, such as cylinders or cuboids. The overall density of a tablet preferably lies in a range from 1040 or 1050 gm/litre up to 1400 gm/litre. The tablet density may well lie in a range up to no more than 1350 or even 1250 gm/litre.

EXAMPLES 1 to 4

A detergent base powder, incorporating organic surfactants, a small percentage of crystalline sodium acetate trihydrate, and zeolite MAP detergency builder was made using known granulation technology. It had the following composition, which is shown both as weight percentages of the base powder and as parts by weight.

| Ingredient | % by Weight | Parts by Weight |
|---|---|---|
| Sodium linear alkylbenzene sulphonate | 23.65 | 11.12 |
| nonionic surfactant (C13–15 branched fatty alcohol 7EO) | 7.10 | 3.34 |
| Soap | 1.25 | 0.59 |
| zeolite A24 | 45.82 | 21.54 |
| Sodium acetate trihydrate | 6.17 | 2.90 |
| Sodium carbonate | 6.63 | 3.12 |
| sodium carboxymethyl cellulose (SCMC) | 0.96 | 0.45 |
| Sodium sulphate, moisture and minor ingredients | 8.42 | 3.96 |
| Total | 100 | 47.00 |

The amount of zeolite MAP (zeolite A24) in the table above is the amount which would be present if it was anhydrous. Its accompanying small content of moisture is included as part of the moisture and minor ingredients. Sodium carboxymethyl cellulose is a commonly used water-soluble antiredeposition polymer.

Coconut husk material was obtained as the residue after removal of fibres. It was observed to consist of particles which were mostly smaller than 2 mm, and contained some contaminants such as fragments of bark, larger than 2 mm.

The husk material was supplied in the form of compacted bricks. These were broken up by hand into small lumps which were further broken up and milled to powder in a kitchen blender. It was then sieved to remove any particles larger than 2,000 micrometers.

The resulting material had a mean particle size of 660 micrometers and a Rosin-Rammler "n" value of 1.65.

Its particle size distribution was

| Sieve fraction | Percent by weight |
|---|---|
| <125 micrometers | 4.9% |
| 125–180 micrometers | 5.7% |
| 180–710 micrometers | 57.5% |
| 710–1,400 micrometers | 27.2% |
| 1,400–2,000 micrometers | 4.6% |

The base powder, the coconut husk material and other ingredients were mixed together as set out in the table below. The resulting compositions were compacted into single layer (i.e. homogenous) cylindrical tablets of weight 40 g using a Carver hand press and a 44 mm diameter die.

The tablets were made with two magnitudes of applied compaction force.

The strength of the tablets, in their dry state as made on the press, was determined as the force needed to break the tablet, measured using an Instron type universal testing instrument to apply compressive force on a tablet diameter (i.e. perpendicular to the axis of a cylindrical tablet). The applied force F was progressively increased until the tablet breaks, whereupon the force at failure Ff in Newtons was recorded.

Tablet disintegration was determined by means of a test in which a tablet of known dry weight resting on a fine metal gauze was placed in a large volume of demineralised water at 20° C. The water was not agitated. After 1 minute the residue on the gauze was removed from the water and weighed.

This residue consisted of the portion of the tablet which had not dissolved or disintegrated, plus water which it had absorbed.

The weight of the residue was expressed as a percentage of the original tablet weight. If a tablet disintegrated well in this test where the water was not agitated, the percentage residue will be small. If a tablet absorbed water but did not disintegrate, the percentage residue may be over 100%.

as above. The particle size ranges and the residue results are set out in the following table:

| Coconut husk material: sieve fraction (micrometers) | residue percentage |
|---|---|
| 1,400–2,000 | 13 |
| 1,000–1,400 | 12 |
| 710–1,000 | 0 (ie no residue) |
| 500–710 | 11 |

EXAMPLE 6 to 8

The detergent base powder used in Examples 1 to 4 was used to make tablets where the water swellable plant material was powdered wood.

Small wood chips, as sold for animal litter, were milled to powder in a kitchen blender. The resulting powder, which resembled sawdust, was sieved to remove any particles larger than 2,000 micrometers.

| The tablet compositions and the results obtained are set out in the following table: Example No | 1a % | 1b % | 2a % | 2b % | 3a % | 3b % | 4a % | 4b % | 4c % |
|---|---|---|---|---|---|---|---|---|---|
| Base powder, as above | 47.0 | 47.0 | 47.0 | 47.0 | 47.0 | 47.0 | 47.0 | 47.0 | 56.5 |
| Antifoam granules | 2.70 | 2.70 | 2.70 | 2.70 | 2.70 | 2.70 | 2.70 | 2.70 | 3.25 |
| Fluorescer on sodium carbonate | 2.70 | 2.70 | 2.70 | 2.70 | 2.70 | 2.70 | 2.70 | 2.70 | 3.25 |
| Soil release polymer (18% active) | 1.00 | 1.00 | 1.00 | 1.00 | 1.00 | 1.00 | 1.00 | 1.00 | 1.20 |
| Sodium acetate trihydrate | 21.0 | nil | 20.0 | nil | 18.5 | nil | 16.0 | nil | nil |
| Sodium carbonate | nil | 21.0 | nil | 20.0 | nil | 18.5 | nil | 16.0 | nil |
| Coconut husk material, as above | nil | nil | 1.00 | 1.00 | 2.50 | 2.50 | 5.00 | 5.00 | 5.00 |
| Acrylate-maleate copolymer | 1.20 | 1.20 | 1.20 | 1.20 | 1.20 | 1.20 | 1.20 | 1.20 | 1.45 |
| Na-silicate (granular) 80% | 3.00 | 3.00 | 3.00 | 3.00 | 3.00 | 3.00 | 3.00 | 3.00 | 3.60 |
| TAED granules (83% active) | 4.00 | 4.00 | 4.00 | 4.00 | 4.00 | 4.00 | 4.00 | 4.00 | 5.00 |
| Percarbonate (coated) | 15.0 | 15.0 | 15.0 | 15.0 | 15.0 | 15.0 | 15.0 | 15.0 | 18.0 |
| Sequestrant granules (Dequest 2047) | 0.74 | 0.74 | 0.74 | 0.74 | 0.74 | 0.74 | 0.74 | 0.74 | 0.88 |

Although these results include some evident experimental variation, the efficacy of the water-swellable disintegrant particles is apparent, since tablets containing 1% of it disintegrate better than the tablets with none, especially when sodium acetate is present among the ingredients added to the base powder.

Tablets with 2.5% or 5% of the swellable coconut husk particles disintegrate even better.

EXAMPLE 5

A different batch of coconut husk material was sieved to provide four sieve fractions. Each fraction was then used to make tablets with the formulation given as example 3a above, and using the same procedure to produce tablets with a with a force at fracture of 40 kN. The tablets were tested The detergent base powder, the wood powder and other ingredients were mixed together as set out in the following table. The resulting compositions were compacted into single layer (i.e. homogenous) cylindrical tablets. For Example 6 and 7 these had a weight of 40 g as in Examples 1 to 4. For Example 8, compositions were compacted into tablets with a weight of about 33 grams.

In all cases the tablets were compacted with a level of compaction force such as to give a force at failure of 40 kN. The tablets were tested as for Examples 1 to 4 and the resdiue values obtained are included in the table below where the results with examples 1a and 1b are included to provide a comparison:

| | Percentages by weight | | | | | | Parts by weight | | |
|---|---|---|---|---|---|---|---|---|---|
| Example No | 1a | 1b | 6a | 6b | 7a | 7b | 8a | 8b | 8c |
| Base powder, as above | 47.0 | 47.0 | 47.0 | 47.0 | 47.0 | 47.0 | 47.0 | 47.0 | 47.0 |
| Antifoam granules | 2.70 | 2.70 | 2.70 | 2.70 | 2.70 | 2.70 | 2.70 | 2.70 | 2.70 |
| Fluorescer on sodium carbonate | 2.70 | 2.70 | 2.70 | 2.70 | 2.70 | 2.70 | 2.70 | 2.70 | 2.70 |
| Soil release polymer (18% active) | 1.00 | 1.00 | 1.00 | 1.00 | 1.00 | 1.00 | 1.00 | 1.00 | 1.00 |

-continued

| | Percentages by weight | | | | | | Parts by weight | | |
|---|---|---|---|---|---|---|---|---|---|
| Example No | 1a | 1b | 6a | 6b | 7a | 7b | 8a | 8b | 8c |
| Sodium acetate trihydrate | 21.0 | nil | 17.2 | nil | 14.2 | nil | nil | nil | nil |
| Sodium carbonate | nil | 21.0 | nil | 17.2 | nil | 14.2 | nil | nil | nil |
| Wood powder, as described above | nil | nil | 5.0 | 5.0 | 7.5 | 7.5 | 2.5 | 5.0 | 7.5 |
| Acrylate-maleate copolymer | 1.2 | 1.2 | 1.2 | 1.2 | 1.2 | 1.2 | 1.2 | 1.2 | 1.2 |
| Na-silicate (granular) 80% | 3.0 | 3.0 | 3.0 | 3.0 | 3.0 | 3.0 | 3.0 | 3.0 | 3.0 |
| TAED granules (83% active) | 4.0 | 4.0 | 4.0 | 4.9 | 4.0 | 4.0 | 4.0 | 4.0 | 4.0 |
| Percarbonate (coated) | 15.0 | 15.0 | 15.0 | 15.0 | 15.0 | 15.0 | 15.0 | 15.0 | 15.0 |
| Sequestrant granules (Dequest 2047) | 0.7 | 0.7 | 0.7 | 0.7 | 0.7 | 0.7 | 0.7 | 0.7 | 0.7 |
| Protease enzyme | 1.2 | 1.2 | nil | nil | nil | nil | nil | nil | nil |
| Perfume | 0.5 | 0.5 | 0.5 | 0.5 | 0.5 | 0.5 | 0.5 | 0.5 | 4.0 |
| Tablet weight (grams) | 40.0 | 40.0 | 40.0 | 40.0 | 40.0 | 40.0 | 32.1 | 33.1 | 34.1 |
| Percent residue for tablets made to have $F_f$ = 40N | 88 | 117 | 75 | 106 | 75 | 63 | 83 | 81 | 69 |

In these examples, the sodium percarbonate, the sodium silicate granules, the sodium acetate trihydrate (if any) and the sodium carbonate (if any) were all instances of the required particles (b) which contain water-soluble salt as at least 50% of their own weight.

It can be seen from the above table that the tablets of Examples 6a and 7a contained less of the water-soluble disintegration-promoting sodium acetate used in example 1a, they had less residue. Examples 6b and 7b improved on Example 1b.

We claim:

1. A detergent tablet of compacted particulate composition comprising:

(a) particles which contain organic surfactant together with water-insoluble detergency builder, and (b) water-insoluble but water-swellable particles of plant material which contain both cellulose and lignin, selected from the group consisting of woodchips and sawdust.

2. A tablet according to claim 1 wherein the tablet or a discrete region thereof comprises from 25 to 85% by weight of the particles (a), and from 0.1 to 12% by weight of the water-insoluble but water-swellable particles (b).

3. A tablet according to claim 1 wherein the particles (a) contain from 12 to 60% of their own weight of organic surfactant and from 20 to 88% of their own weight of detergency builder.

4. A tablet according to claim 1 wherein the tablet further comprises at least 10% by weight of particles (c) which contain from 80 to 100% of their own weight of soluble salt.

5. A tablet according to claim 1 wherein the water-insoluble but water-swellable particles (b) have a mean particle size in a range from 400 to 1,100 micrometers.

6. A tablet according to claim 1 wherein the water-insoluble but water-swellable particles (b) have a mean particle size in a range from 700 to 1,100 micrometers.

7. A tablet according to claim 1 wherein the tablet or a discrete region thereof contains from 8 to 40% by weight of surfactant, from 15 to 80% by weight of detergency builder and from 0.1 to 8% by weight of the said water-insoluble but water-swellable particles (b).

8. A tablet according to claim 1 including some particles (c) which are water-soluble disintegration-promoting particles containing at least 40% by weight of the particles of one or more materials selected from the group consisting of compounds with water-solubility exceeding 50 grams per 100 grams water, phase I sodium tripolyphosphate, sodium tripolyphosphate which is partially hydrated so as to contain water of hydration in an amount which is at least 0.5% by weight of the sodium tripolyphosphate in the particles.

9. A tablet according to claim 8 wherein the disintegration-promoting particles contain at least 40% by weight of the particles of a compound selected from the group consisting of urea, salts with a water-solubility exceeding 50 gm per 10 gms water, and mixtures thereof.

10. A tablet according to claim 8 wherein said disintegration-promoting particles in the tablet or region thereof contain at least 40% by weight of the particles of phase I sodium tripolyphosphate which is partially hydrated so as to contain water of hydration in a range from 0.5 to 4% by weight of these particles.

11. A tablet according to claim 8 wherein the tablet or a discrete region thereof contains from 8 to 25 wt % of said water-soluble disintegration-promoting particles.

12. A tablet according to claim 1 wherein the tablet or a discrete region thereof comprises water-insoluble detergency builder in an amount from 5 to 60% by weight of the tablet or said region thereof.

13. A tablet according to claim 1, which tablet contains a plurality of discrete regions at least one of which contains a greater concentration of the said water-insoluble water-swellable disintegration-promoting particles than another region of the tablet.

14. A tablet according to claim 1 which overall contains 5 to 60 wt % water-insoluble detergency builder.

15. A tablet according to claim 1 which overall further contains from 10 to 80% by weight of water-soluble detergency builder.

16. A tablet according to claim 1 which overall contains 8 to 40% by weight of surfactant.

17. Process for making a detergent tablet as claimed in claim 1, which comprises mixing particulate ingredients comprising water-insoluble, water-swellable disintegration-promoting material as defined in claim 1 and surfactant so as to form a particulate detergent composition which comprises surfactant and water-insoluble detergency builder and compacting a quantity of the particulate composition in a mould so that it forms a tablet or a region of a tablet.

* * * * *